US007043170B2

(12) United States Patent
Ono et al.

(10) Patent No.: US 7,043,170 B2
(45) Date of Patent: May 9, 2006

(54) IMAGE FORMING APPARATUS HAVING SPEED CONTROL OF PRIMARY AND SECONDARY IMAGE TRANSFERS

(75) Inventors: Toru Ono, Tokyo (JP); Shinichi Takata, Tokyo (JP); Shigemichi Hamano, Tokyo (JP); Akihiko Sato, Tokyo (JP); Kenji Morita, Tokyo (JP); Yushi Oka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 10/835,328

(22) Filed: Apr. 28, 2004

(65) Prior Publication Data

US 2004/0218938 A1 Nov. 4, 2004

(30) Foreign Application Priority Data

May 1, 2003 (JP) ..... 2003-126446

(51) Int. Cl.
*G03G 15/00* (2006.01)

(52) U.S. Cl. ..... 399/45; 399/66

(58) Field of Classification Search ..... 399/45, 399/66, 302

See application file for complete search history.

(56) References Cited

U.S. PATENT DOCUMENTS 5,999,760 A * 12/1999 Suzuki et al. ..... 399/45
6,192,205 B1 * 2/2001 Motohashi ..... 399/66
6,766,124 B1 * 7/2004 Taguchi et al. ..... 399/66

FOREIGN PATENT DOCUMENTS

JP 4-67174 A 3/1992
JP 9-146434 A 6/1997

* cited by examiner

*Primary Examiner*—Sandra L. Brase
(74) *Attorney, Agent, or Firm*—Canon U.S.A. Inc IP Division

(57) ABSTRACT

An image-forming apparatus includes a rotatable photoreceptor carrying a toner image thereon, a rotatable intermediate transfer member, a primary transfer device facilitating primary transfer of the toner image from the photoreceptor onto the intermediate transfer member, a secondary transfer device facilitating secondary transfer of the toner image from the intermediate transfer member onto a sheet, and a controller controlling rotation speed of the intermediate transfer member. The controller sets the rotation speed at a first speed during primary transfer. After primary transfer and a delay period, the controller changes the rotation speed to a second speed. The controller determines which rotation of the intermediate transfer member to change the speed.

18 Claims, 12 Drawing Sheets

IMAGE FORMING APPARATUS HAVING SPEED CONTROL OF PRIMARY AND SECONDARY IMAGE TRANSFERS

BACKGROUND OF THE INVENTION

1. Field of the Invention

The present invention relates to an image forming apparatus which primarily transfers a toner image formed on a photoreceptor onto an intermediate transfer member and then secondarily transfers the toner image on the intermediate transfer member onto a recording sheet.

2. Description of the Related Art

In recent years, electrophotographic image-forming apparatuses have been widely used in which a toner image formed on a photoreceptor is primarily transferred onto an intermediate transfer member, and the toner image on the intermediate transfer member is then secondarily transferred onto a sheet. When the distance between a secondary transfer portion and a fixing portion in such an image-forming apparatus is short, a recording sheet may extend beyond the secondary transfer portion and the fixing portion. As such, the rotating speed of the intermediate transfer member and the rotating speed (i.e., the fixing speed) of the fixing portion must correlate during the secondary transfer.

An image formed on a recording sheet such as a sheet of thick paper, an envelope, a postcard, an OHP sheet, a label sticker, a tabbed sheet, or a tracing paper cannot be satisfactorily fixed at a fixing speed applied to a sheet of normal paper. Instead, the fixing speed applied to the predetermined sheets mentioned above must be reduced relative to the fixing speed applied to a sheet of normal paper. Accordingly, in the case of forming an image on a recording sheet such as a sheet of thick paper, an envelope, a postcard, an OHP sheet, a label sticker, a tabbed sheet, or a tracing paper, the rotating speed of the intermediate transfer member must also be reduced so as to correlate with the reduced fixing speed, thereby leading to a decrease in productivity.

Japanese Patent Laid-Open No. 4-67174 discloses an image-forming apparatus in which the intermediate transfer member is rotated at a predetermined rotating-speed during primary transfer. Immediately after completion of the primary transfer, the rotating speed of the intermediate transfer member is reduced to the fixing speed so as to perform the secondary transfer. With this configuration, a decrease in productivity during the primary transfer can be minimized.

In the above-mentioned image-forming apparatus, however, it takes a long period of time after the speed reduction of the intermediate transfer member to start of the secondary transfer, thereby decreasing productivity.

Also, Japanese Patent Laid-Open No. 9-146434 discloses an image-forming apparatus in which the distance between primary and secondary transfer portions of the intermediate transfer member is set longer than the maximum length of any image. The speed reduction of the intermediate transfer member starts when the front edge of an image formed on the intermediate transfer member reaches a predetermined distance from a secondary transfer position and finishes before the front edge reaches the secondary transfer position.

The above image-forming apparatus works satisfactorily on the premise that the distance between the primary and secondary transfer portions of the intermediate transfer member is equal to or greater than the sum of the maximum length of any one image and a length needed for the speed reduction of the intermediate transfer member. Hence, Japanese Patent Laid-Open No. 9-146434 proposes that the distance between the primary and secondary transfer portions of the intermediate transfer member be configured longer in order to form a longer image.

Unfortunately, in some image-forming apparatuses, the distance between the primary and secondary transfer portions of the intermediate transfer member cannot be configured longer because of structural restrictions. Also, in some image-forming apparatuses in recent years, a plurality of images is formed on the entire loop of the intermediate transfer member. In such an image-forming apparatus, complete speed reduction of the intermediate transfer member depends on the size of an image and the number of images formed on the entire loop of the intermediate transfer member. Accordingly, if the secondary transfer is always performed when the front edge of an image formed on the intermediate transfer member reaches the secondary transfer portion after finish of the primary transfer, the secondary transfer may start before the speed reduction of the intermediate transfer member is completed and is therefore performed in a state in which the rotating speed of the intermediate transfer member is higher than the fixing speed.

SUMMARY OF THE INVENTION

The present invention has been made in order to solve the above-mentioned problems. Accordingly, the present invention is directed to an image-forming apparatus and a method for forming an image which achieves an improvement in productivity by shortening a time period from finish of a primary transfer to start of a secondary transfer.

The image forming apparatus includes a rotatable photoreceptor carrying a toner image thereon, a rotatable intermediate transfer member, a primary transfer device facilitating primary transfer of the toner image from the photoreceptor onto the intermediate transfer member, a secondary transfer device facilitating secondary transfer of the toner image from the intermediate transfer member onto a sheet, and a controller controlling rotation speed of the intermediate transfer member. During primary transfer, the controller sets the rotation speed of the intermediate transfer member at a first speed.

In one aspect of the present invention, after primary transfer and depending on sheet type, the controller either maintains the rotation speed at the first speed or changes the rotation speed to a second speed after a delay period. In one embodiment, if sheet type is a predetermined sheet type (one of a sheet of thick paper, an envelope, a postcard, an OHP sheet, a label sticker, a tabbed sheet, and a tracing paper), the controller changes the rotation speed to the second speed after primary transfer. Otherwise, the controller maintains the rotation speed at the first speed after primary transfer. In one embodiment, the first speed is faster than the second speed.

In another aspect, for predetermined sheet types, the controller determines which rotation of the intermediate transfer member to change the rotation speed. In one embodiment, the controller determines whether to change the speed during a rotation wherein the primary transfer is completed or during a following rotation, such as an immediately following rotation. In another embodiment, the controller determines which rotation to change the speed by determining whether a distance between the front edge of the toner image on the intermediate transfer member and the secondary transfer device at the time of completion of the primary transfer is longer or shorter than a predetermined distance. If longer, speed change occurs during the primary rotation. If shorter, speed change occurs during the following rotation.

In another aspect, the image forming apparatus includes the intermediate transfer member including a marker and includes a sensor detecting the marker. For predetermined sheet types, the controller changes rotation speed immediately before the sensor detects the marker.

Further objects, features and advantages of the present invention will become apparent from the following description of the preferred embodiments with reference to the attached drawings.

DESCRIPTION OF THE PREFERRED EMBODIMENTS

Figure 1:
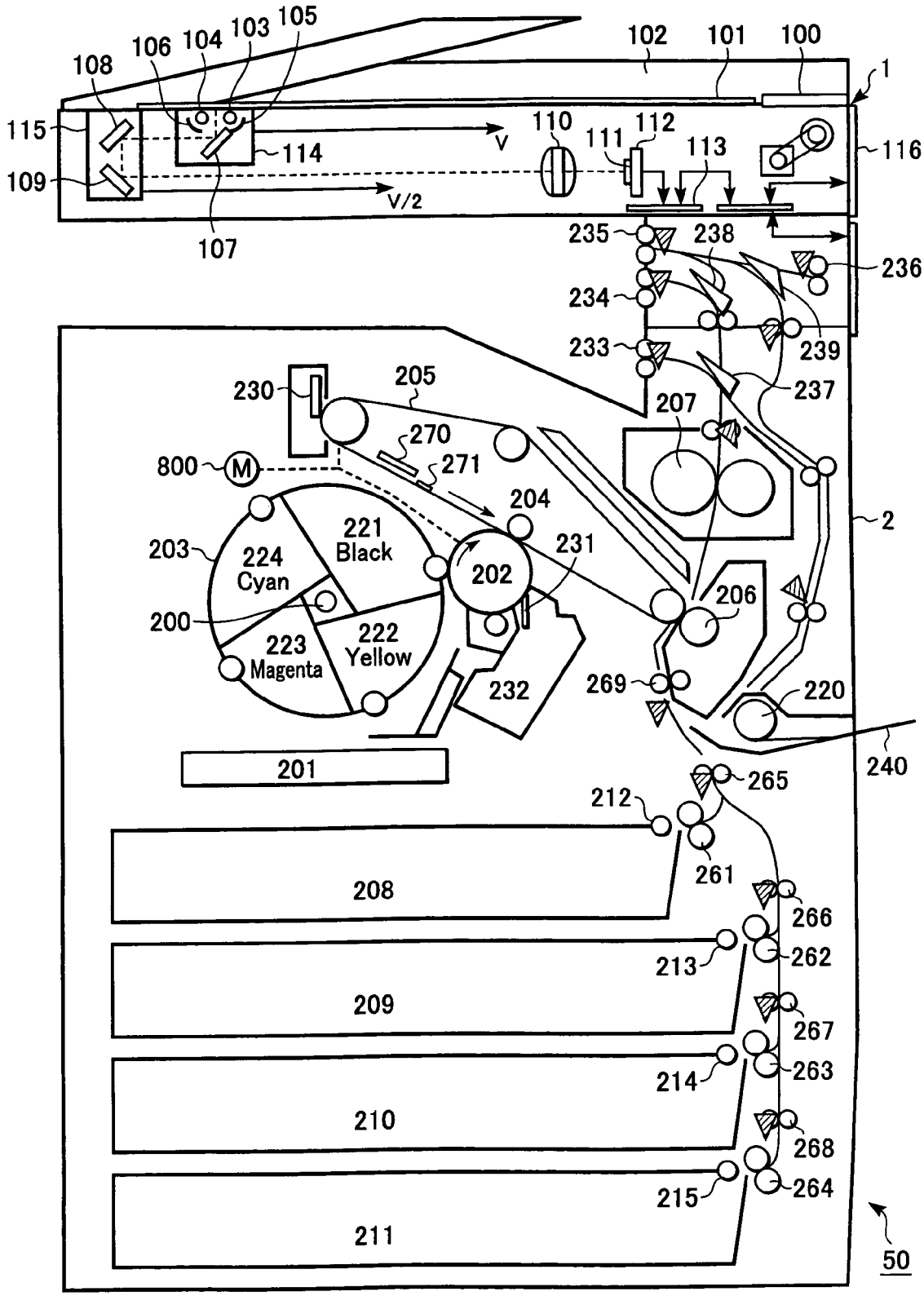
FIG. 1 is a schematic view of a color-image forming apparatus according to one embodiment of the present invention.

A color-image forming apparatus according to one embodiment of the present invention will be described with reference to the attached drawings.

Like parts identified by the same reference numbers in the drawings represent the same parts and their repetitive descriptions are omitted.

FIG. 1 is a schematic view of a color-image forming apparatus 50 in accordance with one embodiment of the present invention.

The color-image forming apparatus 50 includes a color-image reader unit (hereinafter, simply referred to as a reader unit) 1 and a color-image printer unit (hereinafter, simply referred to as a printer unit) 2, respectively disposed in the upper and lower parts thereof.

The reader unit 1 includes a control unit 100, an original glass-plate (platen) 101, an automatic document feeder (ADF) 102, light sources 103 and 104 for illuminating an original, and arc-shaped reflectors 105 and 106.

The reader unit 1 also includes mirrors 107 to 109, a lens 110, and a CCD (charge-coupled device) image sensor (hereinafter, simply referred to as a CCD) 111.

In addition, the reader unit 1 includes a board 112 and a digital-image processing unit 113.

Furthermore, the reader unit 1 includes a carriage 114 for housing the light sources 103 and 104, the arc-shaped reflectors 105 and 106, and the mirror 107, and a carriage 115 for housing the mirrors 108 and 109.

Moreover, the reader unit 1 includes an external interface (I/F) (hereinafter, sometimes referred to as an external I/F) 116 for interfacing with external devices.

Next, the structure of the printer unit 2 will be described.

The printer unit 2 has an image forming means including a rotating shaft 200, a laser scanner 201 serving as latent-image forming means, a photosensitive drum 202 serving as a photoreceptor, and a color developing unit 203 having developing means and development-changing means.

The printer unit 2 also includes a primary transfer roller 204.

In addition, the printer unit 2 includes an intermediate transfer member 205, a secondary transfer roller 206, a fixing roller 207, cassettes 208 to 211, pickup rollers 212 to 215, a manual paper-feeding roller 220, developing devices 221 to 224, a cleaning blade 230, a blade 231, a waste-toner box 232, a pair of first paper-discharging rollers 233, a pair of second paper-discharging rollers 234, a pair of reversing rollers 235, a pair of third paper-discharging rollers 236, a first paper-discharging flapper 237, a second paper-discharging flapper 238, a third paper-discharging flapper 239, a manual sheet-tray 240, pairs of paper-feeding rollers 261 to 264, pairs of vertical-path transporting rollers 265 to 268, a pair of registration rollers 269, and home-position (HP) detecting sensors/marker 270 and 271.

The structure of the reader unit 1 will now be described.

The reader unit 1 mainly includes the original glass-plate (platen) 101 and the automatic document feeder (ADF) 102. Instead of the automatic document feeder 102, the reader unit 1 may have a mirror platen or a white platen (both not shown).

The light sources 103 and 104 for illuminating an original document can be halogen lamps, fluorescent lamps, xenon lamps, or the like. The arc-shaped reflectors 105 and 106 focus light emitted from the light sources 103 and 104 onto the original placed on the original glass-plate 101.

The light reflected off the original placed on the original glass-plate 101 is then focused on the CCD 111 by the lens 110.

The CCD 111 is mounted on the board 112. The control unit 100 controls the overall image forming apparatus 50.

The carriage 114 houses the light sources 103 and 104, the arc-shaped reflectors 105 and 106, and the mirror 107 therein. The carriage 115 houses the mirrors 108 and 109 therein.

Meanwhile, the carriages 114 and 115 move automatically at speeds of V and V/2, respectively, along a sub-scanning direction Y perpendicular to an electrical scanning direction (main-scanning direction X) of the CCD 111 so as to scan the entire surface of the original placed on the original glass-plate 101.

The external interface (I/F) 116 serves as an interface with external devices such as a personal computer or a network.

Figure 2:
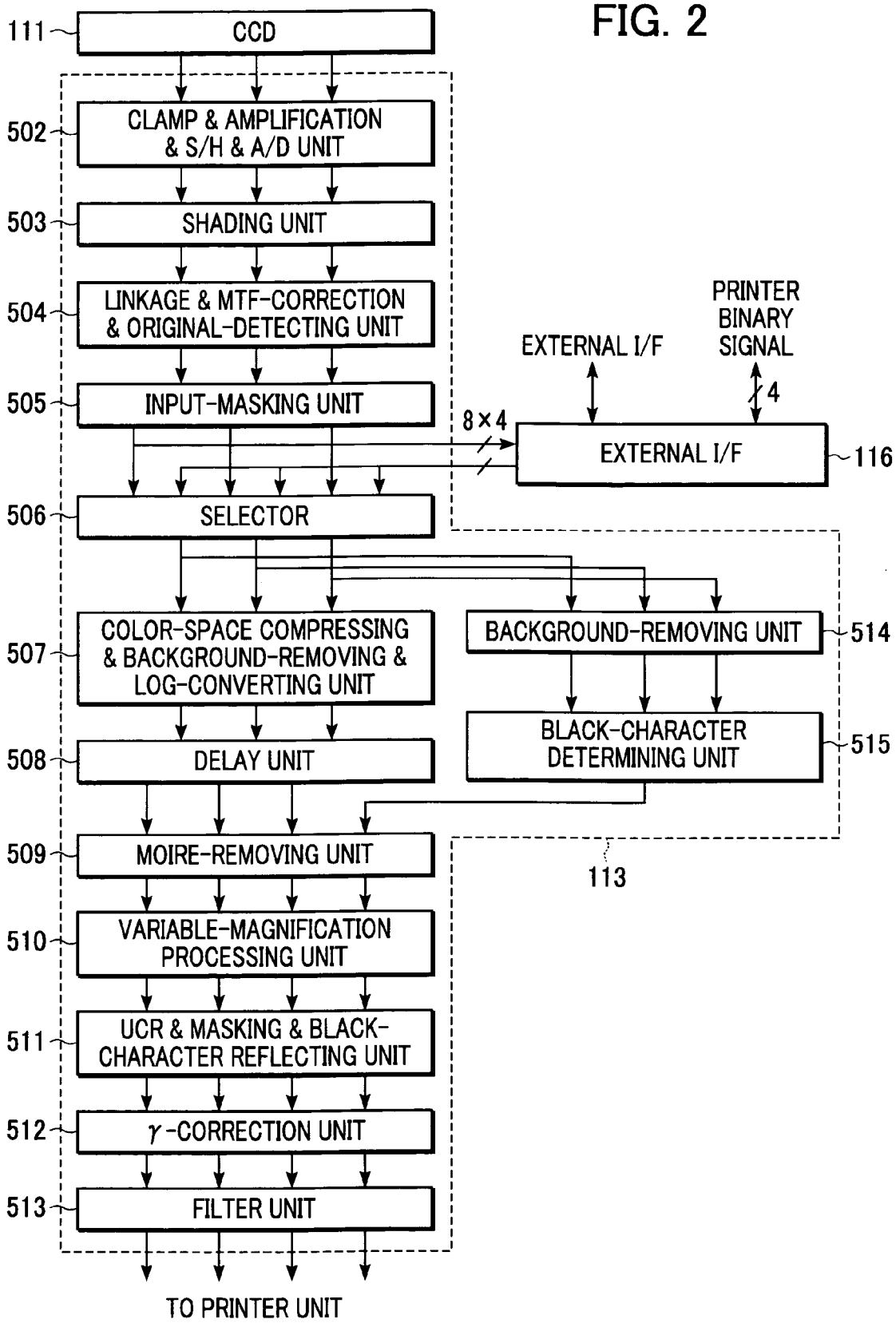
FIG. 2 is a block diagram of the digital image processing unit.

FIG. 2 is a block diagram of the digital-image processing unit 113.

The digital-image processing unit 113 includes a clamp & amplification & S/H & A/D unit 502, a shading unit 503, a linkage & MTF-correction & original-detecting unit 504, an input-masking unit 505, a selector 506, a color-space compressing & background-removing & LOG-converting unit 507, a delay unit 508, a moire-removing unit 509, a variable-magnification processing unit 510, a UCR & masking & black-character reflecting unit 511, a γ-correction unit 512, a filter unit 513, a background-removing unit 514, and a black-character determining unit 515.

Referring to FIG. 1, light emitted from the light sources 103 and 104 is reflected off the original placed on the original glass-plate 101, is guided to the CCD 111, and is converted to electrical signals (when the CCD 111 is a color sensor, the CCD 111 may be an one-line CCD having three color filters for RGB colors aligned in line thereon in the order of RGB colors, or three-line CCDs respectively having R, G, and B filters disposed thereon; or alternatively, these filters may be mounted on a chip or constructed independently from the CCD(s)).

Electrical signals (analog image signals) are inputted into the digital-image processing unit 113. In the clamp & amplification & S/H & A/D unit 502, the electrical signals are subjected to sample-and-hold (S/H), are clamped with a reference voltage of a dark level of the analog image signals, are amplified to predetermined magnitudes (although not limited to the above processing order), are subjected to A/D conversion, and are converted into, for example, eight-bit digital signals for the respective RGB colors.

These RGB signals are subjected to shading and black corrections in the shading unit 503. If the CCD 111 is, for example, three-line CCDs, reading positions of three lines are different from one another. As such, linkage processing is performed in the linkage & MTF-correction & original-detecting unit 504 such that a delayed amount of each line is adjusted in accordance with a reading rate, and a signal timing is corrected so that the reading positions of the three lines agree with one another.

Also, since a reading MTF varies depending on a reading rate and a magnification rate, an MTF correction is performed so as to correct the variance, and an original detection is performed by scanning over the original placed on the original glass-plate 101 so as to recognize the size of the original.

The digital signals, having corrected timings of their reading-positions, correct the spectral characteristics of the CCD 111, the light sources 103 and 104, and the arc-shaped reflectors 105 and 106 in the input-masking unit 505.

Outputs from the input-masking unit 505 are inputted into the selector 506 whose connection can be changed to external I/F signals.

Output signals from the selector 506 are inputted into the color-space compressing & background-removing & LOG-converting unit 507 and into the background-removing unit 514.

The signals inputted into the background-removing unit 514 are subjected to background-removing processing, are then inputted into the black-character determining unit 515 for determining whether each signal corresponds to a black character appearing in the original so as to produce a black-character signal from the original.

Also, the selector 506 outputs to the color-space compressing & background-removing & LOG-converting unit 507 where color-space compressing is performed so as to determine whether scanned image signals lie within a reproducible range of the printer. If YES, the image signals remain uncorrected, and if NO, the image signals are corrected so as to lie within the reproducible range of the printer.

Then, the image signals are subjected to background-removing and are converted from the RGB signals into YMC signals in the LOG-converting subunit.

In order to correct a signal and a timing produced in the black-character determining unit 515, a timing of each output signal of the color-space compressing & background-removing & LOG-converting unit 507 is adjusted in the delay unit 508.

These two types of signals are subjected to moire-removing in the moire-removing unit 509 and variable-magnification processing in the main-scanning direction in the variable-magnification processing unit 510.

Then, the signals processed in the variable-magnification processing unit 510 are inputted into the UCR & masking & black-character reflecting unit 511. In the unit 511, YMCK signals are produced from the YMC signals in the UCR processing subunit and are corrected in the masking processing subunit so as to be appropriate as outputs of the printer, and determining signals produced in the black-character determining unit 515 are fed back to the YMCK signals.

The signals processed in the UCR & masking & black-character reflecting unit 511 are sent to the γ-correction unit 512 for contrast adjustment and are then sent to the filter unit 513 for smoothing or edge processing.

Then, the processed signals are sent to the printer unit 2.

Figure 3:
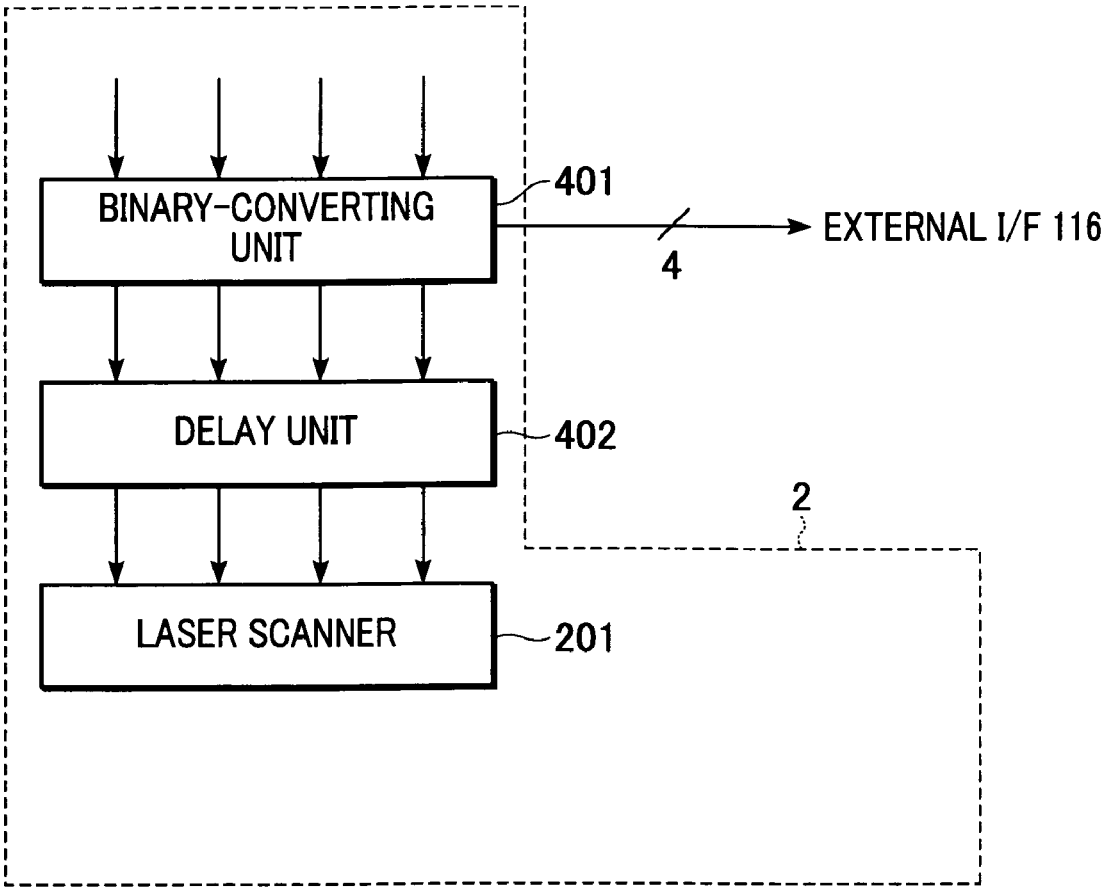
FIG. 3 is a flowchart of image-information process in the printer control unit.

FIG. 3 illustrates a flowchart of receipt processing, in the printer unit 2, of the signals processed in the digital-image processing unit 113.

Eight-bit multilevel signals are converted into binary signals in a binary converting unit 401.

A converting method in this case may be any one of a dithering method, an error diffusion method, an improved error diffusion method, and the like.

The converted binary signals are sent to the external I/F 116 and a delay unit 402.

The received signals are sent to an external output apparatus such as a facsimile machine (not shown) through the external I/F 116.

The delay unit 402 adjusts a timing of each signal sent to the laser scanner 201 in order to correct the received signals and a timing of laser emission of the laser scanner 201.

With this arrangement, the delay unit 402 sends signals to the laser scanner 201.

Alternatively, the binary converting unit 401 and the delay unit 402 may be included in the digital-image processing unit 113.

Figure 4:
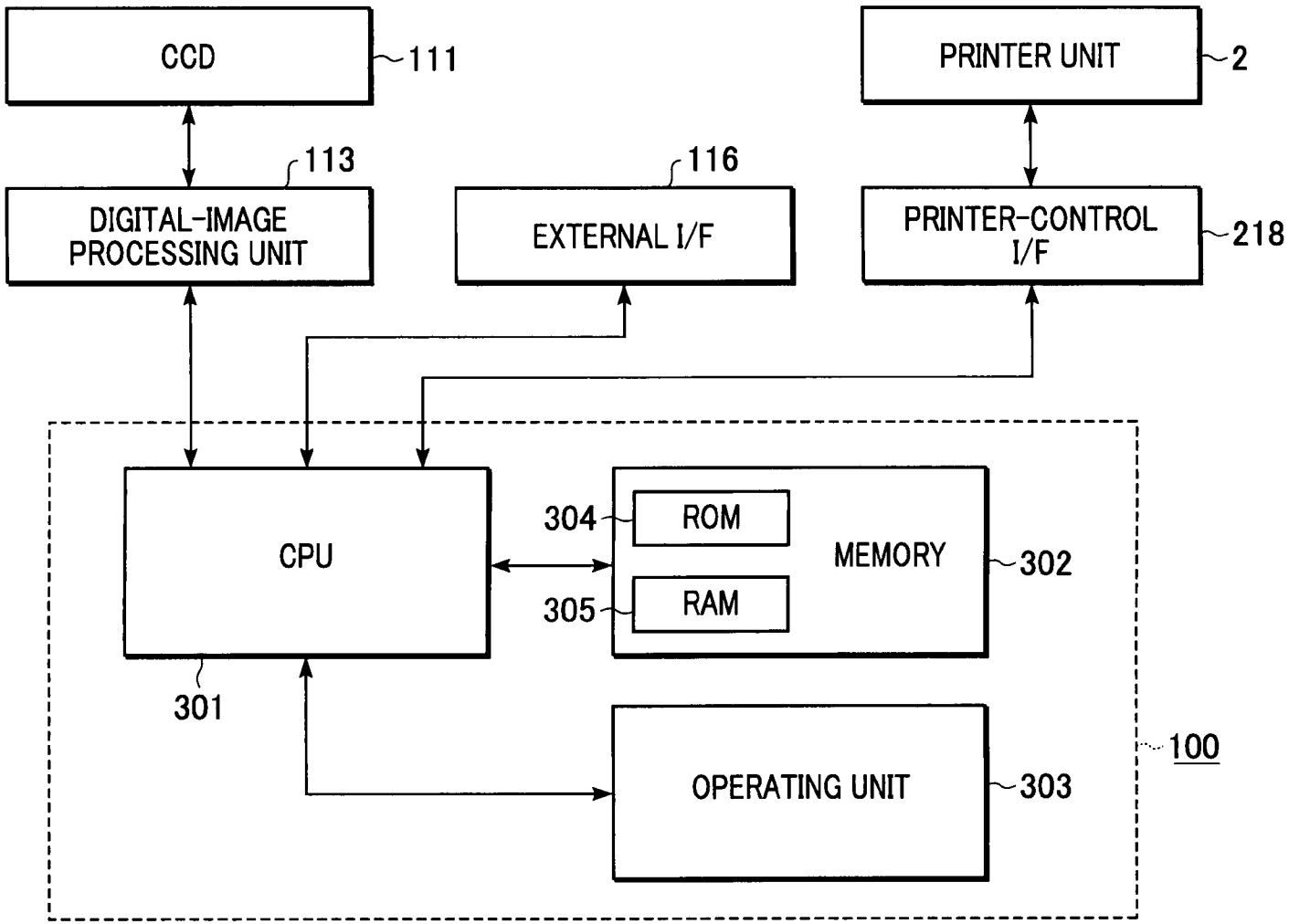
FIG. 4 is a block diagram of the control unit.

FIG. 4 is a block diagram of the control unit 100.

The control unit 100 includes a CPU 301, a memory 302, and an operating unit (operation panel) 303.

The CPU 301 is for reducing a rotating speed of the intermediate transfer member 205 and a transporting speed of a sheet before performing a secondary transfer in accordance with the type of the sheet. The CPU has interfaces (I/Fs) for exchanging information for performing respective controls with the digital-image processing unit 113, a printer-control interface (I/F) 218, and the external I/F 116.

The memory 302 is for storing the size of the sheet therein on which an image is to be formed. The memory 302 includes a ROM 304 for storing a control program of the CPU 301 and a RAM 305 for providing a working area for the CPU 301.

Also, the operating unit 303 includes a liquid-crystal touch panel for inputting a process-executing command by an operator, and for notifying the operator of information about processing, warning, and the like.

Figure 5:
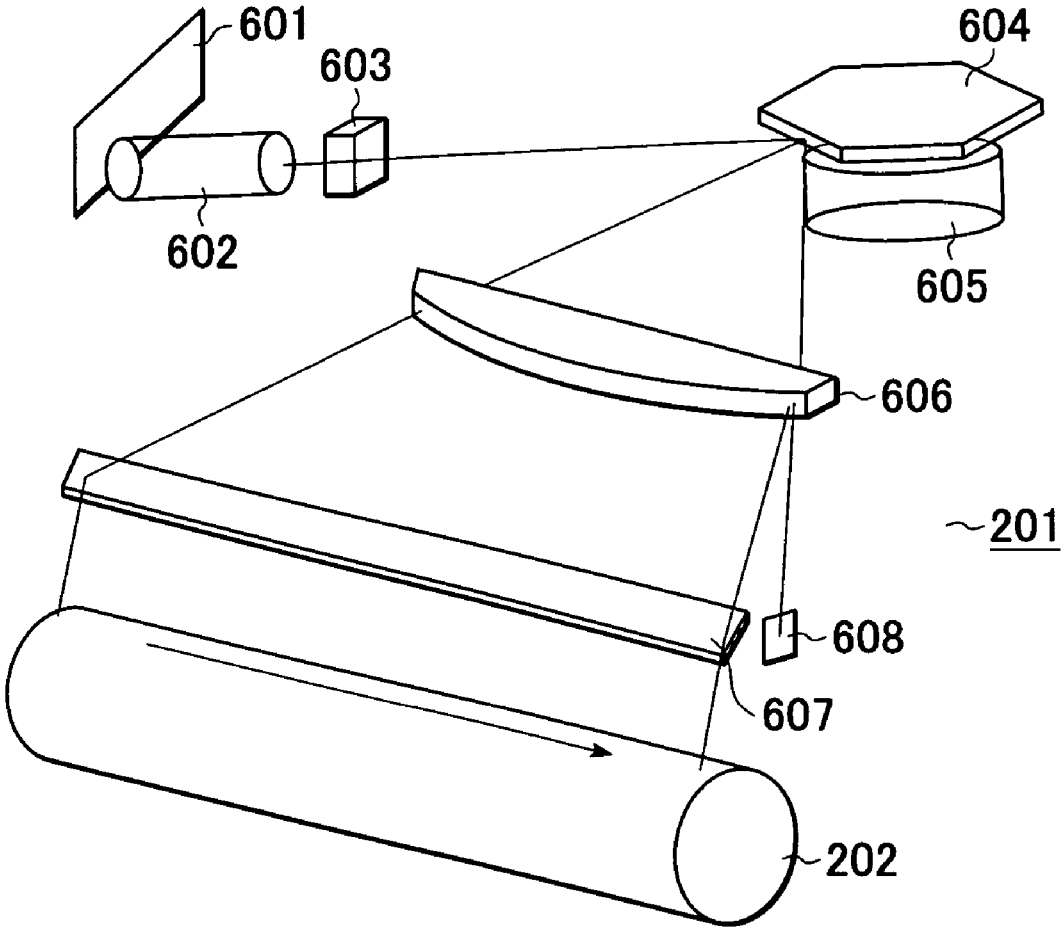
FIG. 5 is a perspective view of the laser scanner.

Referring now to FIGS. 1 and 5, the structure of the color printer unit 2 will be described.

When the printer-control I/F 218 receives a control signal from the CPU 301 of the foregoing control unit 100, the printer unit 2 operates in accordance with the control signal from the printer-control I/F 218.

FIG. 5 is a perspective view of the laser scanner 201.

The laser scanner 201 includes a laser-driver circuit-board 601, a collimator lens 602, a cylindrical lens 603, a polygon mirror 604, a polygon-mirror driving motor 605, an imaging lens 606, a reflecting mirror 607, and a beam-detector (BD) circuit board 608.

Laser light corresponding to an image-data signal is emitted by the laser-driver circuit-board 601, is collimated by the collimator lens 602 and the cylindrical lens 603, and is incident on the polygon mirror 604 rotating at a fixed speed driven by the polygon-mirror driving motor 605.

The laser light reflected off the polygon mirror 604 passes through the imaging lens 606 and the reflecting mirror 607, both disposed between the polygon mirror 604 and the drum 202, and illuminates the photosensitive drum 202 to scan the drum 202 in the main scanning direction shown by the arrow.

As the photosensitive drum 202 rotates counterclockwise (as shown by the arrow in FIG. 1), the laser scanner 201 forms an electrostatic latent image on the photosensitive drum 202.

The rotatable color developing unit 203 includes the developing devices 221 to 224 respectively corresponding to black, yellow, magenta, and cyan colors and disposed clockwise around the rotating shaft 200. The developing devices 221 to 224 develop the electrostatic latent image formed on the photosensitive drum 202 by accreting toner onto the latent image. The developing agent is not limited to toner, but can be another developer.

In the present embodiment, the developing devices 221 to 224 are easily detachable from the rotatable color developing unit 203 and are attached at respectively designated color positions.

When a toner image is to be formed on the photosensitive drum 202, in the case of developing a monochromatic black image, only the black developing device 221 is used. The rotatable color developing unit 203 is rotated so as to face a developing sleeve of the black developing device 221 relative to the photosensitive drum 202. Toner, having a potential difference between the surface of the photosensitive drum 202 having the electrostatic latent image formed thereon and the surface of the developing sleeve having a developing bias applied thereon, is ejected from developing device 221 towards the surface of the photosensitive drum 202. Accordingly, the electrostatic latent image on the surface of the photosensitive drum 202 is developed.

In the case of forming a color image, a stepping motor (not shown) rotates the rotatable color developing unit 203 about the rotating shaft 200 such that a predetermined one of the developing devices 221 to 224 corresponding one of the colors used for development selectively comes close to (or comes into contact with) the photosensitive drum 202 in order to perform development.

Toner, having a charge corresponding to electrical charges on the photosensitive drum 202, is fed from each of the developing devices 221 to 224 so as to develop an electrostatic latent image on the photosensitive drum 202.

The photosensitive drum 202 having a toner image formed thereon is rotated clockwise. The primary transfer roller 204 facilitates primary transfer of the toner image formed on the photosensitive drum 202 onto the intermediate transfer member 205. During primary transfer, the CPU 301 controls a bias voltage of the primary transfer roller 204.

In the case of forming a full color image, since the primary transfer onto the intermediate transfer member 205 is performed for each color, a primary transfer for the full color image is completed when four primary transfers for the four colors are performed onto the intermediate transfer member 205.

When an image corresponds to a specific sheet size, for example, an A4 size, or smaller, the intermediate transfer member 205 has a capacity of forming two images corresponding to two sheets (two pages) thereon.

A sheet, fed from one of the cassettes 208 to 221 by the corresponding one of the pickup rollers 212 to 215, is transported by the corresponding one or ones of the pairs of paper-feeding rollers 261 to 264 to the pair of registration rollers 269 by the corresponding one of pairs of vertical-path transporting rollers 265 to 268.

In the case of manual feeding, the manual paper-feeding roller 220 transports each sheet stacked on the manual sheet-tray 240 to the pair of registration rollers 269.

Each of the above sheets is transported into a nip located between the intermediate transfer member 205 and the secondary transfer roller 206 upon completion of the primary transfer onto the intermediate transfer member 205.

As the sheet is being transported towards the fixing roller 207, the sheet is sandwiched between the secondary transfer roller 206 and the intermediate transfer member 205, whereby the sheet contacts with the intermediate transfer member 205. As such, the secondary transfer roller 206 facilitates secondary transfer of a toner image on the intermediate transfer member 205 onto the sheet. The CPU 301 facilitates secondary transfer by controlling a bias voltage of the secondary transfer roller 206.

The fixing roller 207 and a pressure roller heats and applies a pressure, respectively, onto the toner image transferred onto the sheet to fix the toner image on the sheet.

Residual toner, if any, remaining on the intermediate transfer member 205 is scraped off the surface of the intermediate transfer member 205 by the cleaning blade 230. The cleaning blade 230, which is capable of moving into and out of contact with the surface of the intermediate transfer member 205, rubs against the surface of the intermediate transfer member 205 so as to clean off the residual toner in the post-treatment control of the latter half of an image-forming sequence.

In a photosensitive drum unit, the blade 231 scraps the residual toner off the surface of the drum 202. The scrapped residual toner is then transported to the waste-toner box 232 disposed in and integrally formed with the photosensitive drum unit.

In addition, positively and negatively charged residual toner unexpectedly adsorbed on the surface of the secondary transfer roller 206 can be scraped off by alternately applying secondary-transfer forward and reverse biases on the residual toner so as to adsorb it on the intermediate transfer member 205. The intermediate-transfer cleaning blade 230 can then scrape off the residual toner to complete the post-treatment control.

In the case of a first discharge sheet, by switching the first paper-discharging flapper 237 towards the pair of first paper-discharging rollers 233, the sheet having an image fixed thereon is discharged towards the pair of first by paper-discharging rollers 233.

In the case of a second discharge sheet, by switching the first paper-discharging flapper 237 and the second paper-discharging flapper 238 toward the pair of second paper-discharging rollers 234, the sheet is discharged towards the pair of second paper-discharging rollers 234.

In the case of a third discharge sheet, it is necessary to reverse the sheet one time with the pair of reversing rollers 235. Hence, by switching the first paper-discharging flapper 237 and the second paper-discharging flapper 238 toward the pair of reversing rollers 235, the sheet is reversed with the pair of reversing rollers 235.

The sheet is reversed one time with the pair of reversing rollers 235 by switching the third paper-discharging flapper 239 towards the pair of third paper-discharging rollers 236, and then the sheet is discharged towards the pair of third paper-discharging rollers 236.

In the case of a double-surface discharge sheet, the sheet is reversed one time with the pair of reversing rollers 235 in the same manner as in the case of the third discharge sheet. The sheet is then transported to a double-surface unit by switching the third paper-discharging flapper 239 towards the double-surface unit.

An image-forming operation of the image forming apparatus 50 is temporally suspended after a predetermined time period from detection of the present sheet with a double-surface sensor. As soon as the apparatus 50 becomes ready for forming an image, the following sheet is fed, and the operation is resumed so as to form an image on the following sheet.

An image-forming control that takes productivity into consideration, which is a feature of the present embodiment, will be described together with those of comparative examples with reference to FIGS. 6 to 12.

Image-forming controls of comparative examples will be first described.

Image-Forming Control of Comparative Example 1

Figure 6:
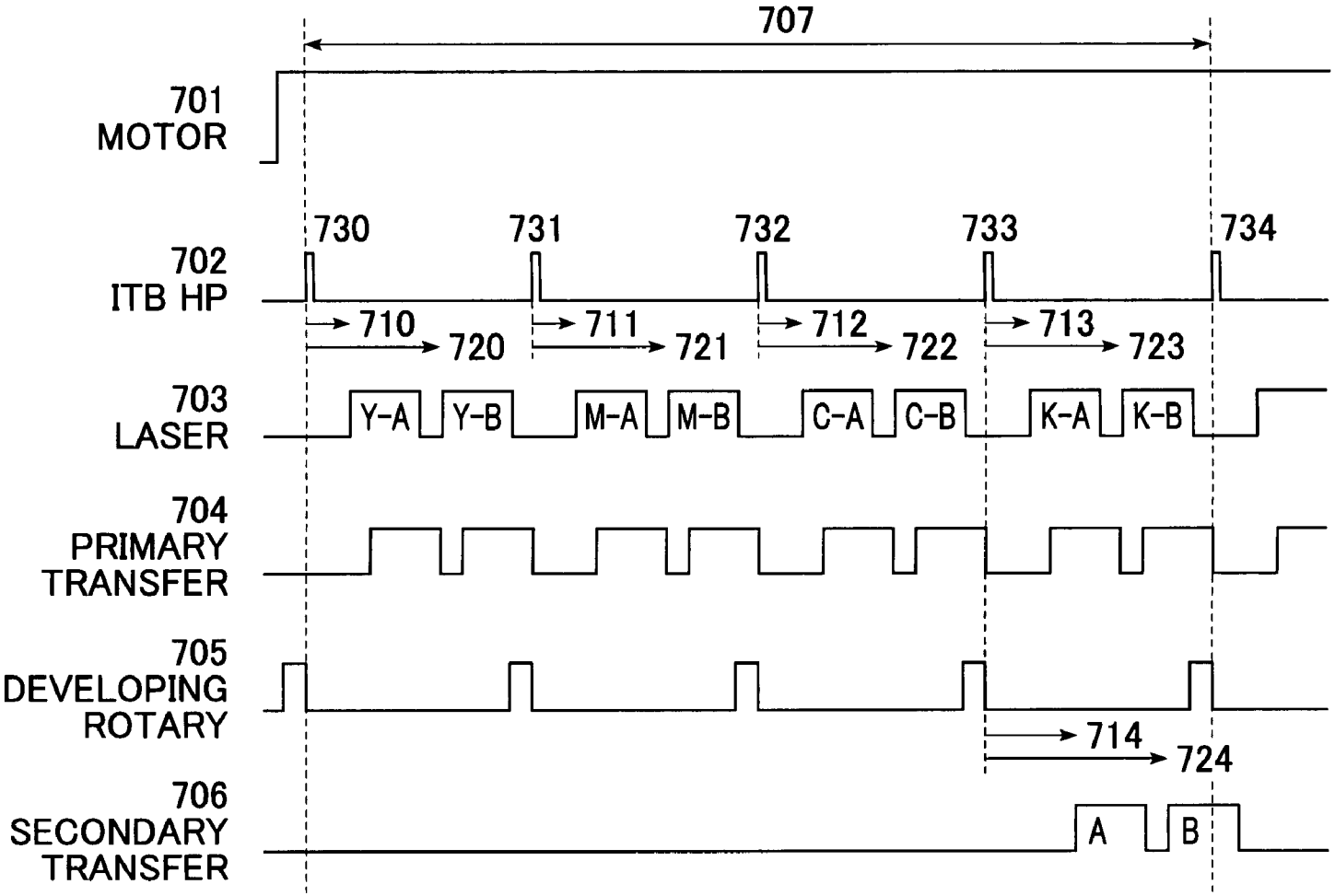
FIG. 6 illustrates a timing chart for forming an image in the double image mode for normal paper as a comparative example 1.

FIG. 6 illustrates a timing chart for image-forming of two attached normal sheets of paper as a comparative example 1.

A speed-change timing 701 is used for changing the speed of a DC brushless motor 800 (shown in FIG. 1) for driving the photosensitive drum 202 and the intermediate transfer member 205. When a sheet of normal paper is outputted, the motor is rotated at a speed of V1 for sheets of normal paper.

An HP signal 702 is used for determining a timing of the front edge of an image. The HP signal 702 is outputted every time the HP-detecting sensor 270 detects the home-position (HP) seal/marker 271 attached in the intermediate transfer member 205.

A timing 703 is used for laser emissions of the image data. Laser emissions start at a predetermined time period after detection of the HP signal 702. This operation is performed for each of the four colors so as to form a color image with little color drift. In this example, two sub-images corresponding to two A4-size sheets are formed at the same time, wherein one sub-image on the first sheet in the double image mode is formed during time periods Y-A, M-A, C-A, and K-A, and the other sub-image on the second sheet is formed during time periods Y-B, M-B, C-B, and K-B. Herein, the term "double image mode" refers to two sub-images corresponding to two pages being transferred on the intermediate transfer member 205.

A timing 704 is used for primary transfer of the toner image formed on the photosensitive drum 202 onto the intermediate transfer member 205.

A timing 705 is used for rotating the rotatable color developing unit (hereinafter, referred to as the developing rotary) 203 so as to cause a developing device to move closer to the photosensitive drum 202.

A timing 706 is used for secondary transfer of the toner image from the intermediate transfer member 205 onto a sheet. The timing 706 is determined with reference to the HP signal 702.

A period 707 is defined as a time interval from forming a latent image to performing a secondary transfer.

In the case of forming an image in the single image mode, only the time periods Y-A, M-A, C-A, and K-A in the timing 703, the timing 704, and the secondary transfer during a time period A in the timing 706 are controlled. In the case of forming an image corresponding to three or more sheets of paper, control in the period 707 is repeated.

Time periods 710, 711, 712, and 713 are from detection of the respective HP signals 730, 731, 732, and 733 to corresponding start of laser emission.

A time period 714 is from detection of the HP signal 733 to start of the secondary transfer.

Time periods 720, 721, 722, and 723 are from detection of the respective HP signals 730, 731, 732, and 733 to the corresponding start of laser emission for forming an image on the second sheet in the double image mode.

A time period 724 is from detection of the HP signal 733 to start of the secondary transfer of the image on the second sheet in the double image mode.

Image-Forming Control of Comparative Example 2

Figure 7:
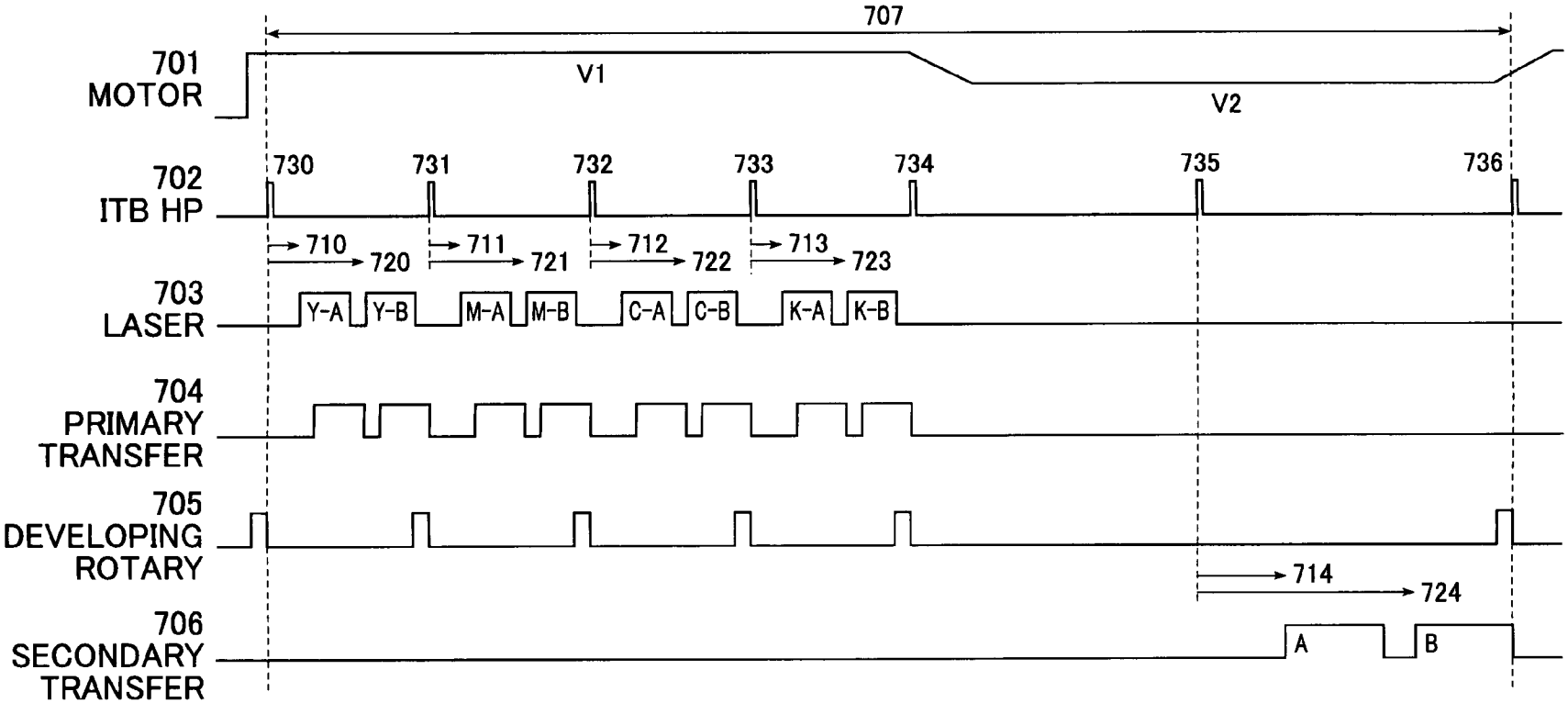
FIG. 7 illustrates a timing chart for forming an image in the double image mode for thick paper as a comparative example 2.

FIG. 7 illustrates a timing chart for forming a full color image in the double image mode for thick sheets of paper or envelopes.

FIG. 7 is an illustration of a timing chart for image-forming in the double image mode for thick paper as a comparative example 2. In this example, the speed of the motor is reduced from V1 to V2 immediately after finish of the primary transfer.

Reference numbers 734 to 736 represent HP signals.

Control timings up to finish of the primary transfer are the same as those for a sheet of normal paper.

When the sheet type is a sheet of thick paper, an envelope, or the like, the CPU 301 controls the motor so as to reduce the sheet transporting speed and the speed of the intermediate transfer member 205 to half of their constant speed V1, taking into consideration a transfer efficiency during the secondary transfer and fixativity during fixation.

In the example illustrated in FIG. 7, the speed of the motor is reduced to a speed V2, which is half the speed V1, immediately after completion of the primary transfer during the time period K-B.

Then, when the speed of the motor becomes stable at the speed V2 and when a time period 714 has lapsed after the HP signal 735 has been detected, a toner image on the intermediate transfer member 205 is secondarily transferred to the sheet. In the example illustrated in FIG. 7, the number of rotations of the intermediate transfer member 205 prior to the secondary transfer changes in accordance with the image size and the number of images on the entire loop of the intermediate transfer member 205. The CPU 301 controls the timing of the secondary transfer in response to the HP signal 735 but does not determine the number of rotations of the intermediate transfer member 205 prior to the secondary transfer. In other words, the CPU 301 does not determine whether, based on the image size and the number of images, whether speed reduction can occur during the same rotation in which primary transfer is completed.

In the case of forming an image corresponding to three or more sheets of paper, after a time period B in the timing 706, the speed of the motor is again increased to V1 and, at the same time, the timing 705 is changed to a Yellow-developing position.

In the case of forming a monochromatic black image, only the following are controlled: the timing 703 for emitting laser, laser emission and the primary transfer during the time period K-A in the timing 704, and the secondary transfer during the time period A in the timing 706.

Also, in the single image mode, for example, in which a sheet having a length longer than an A4 sheet or the short side of a letter-sized sheet is attached on the entire loop of the intermediate transfer member 205 when a full-color image is formed, only the following are controlled: the timing 703, laser emission and the primary transfer during the time periods Y-A, M-A, C-A, and K-A in the timing 704, and the secondary transfer during the time period A in the timing 706.

Productivity according to the timing chart shown in FIG. 7 is the reciprocal of the period 707, which is the period from detection of an HP signal for a timing for forming a first Yellow image to detection of an HP signal for a timing for a third Yellow image.

In an attempt to improve productivity, it is difficult to shorten the time periods for primary and secondary transfers in the period 707 since these time periods depend on the size and the manner of attaching a sheet.

On the other hand, the time period from completion of primary transfer to detection of an HP signal for the secondary transfer can be shortened, depending on the control of the rotating speed of the intermediate transfer member 205. This is due to this time period being independent of sheet size.

Image-Forming Control of Present Embodiment

An image-forming control of the present embodiment will be described.

According to the image-forming control of the present embodiment, in the case of forming an image on a sheet of normal paper, the control of the comparative example 1 described with reference to FIG. 6 is carried out. Also, in the case of forming an image on a sheet of thick paper, an envelope, a postcard, a transparent overhead projector sheet (hereinafter, simply referred to an OHP sheet), a label sticker, a tabbed sheet, or a tracing paper and in the case of reducing the rotating speed of the intermediate transfer member 205 in the process of forming the image, the speed reduction is not carried out immediately after completion of primary transfer but carried out after lapse of a predetermined time interval t_intvl, taking into consideration a time period t_v needed for reducing the speed of the motor and the sheet size.

Figure 8:
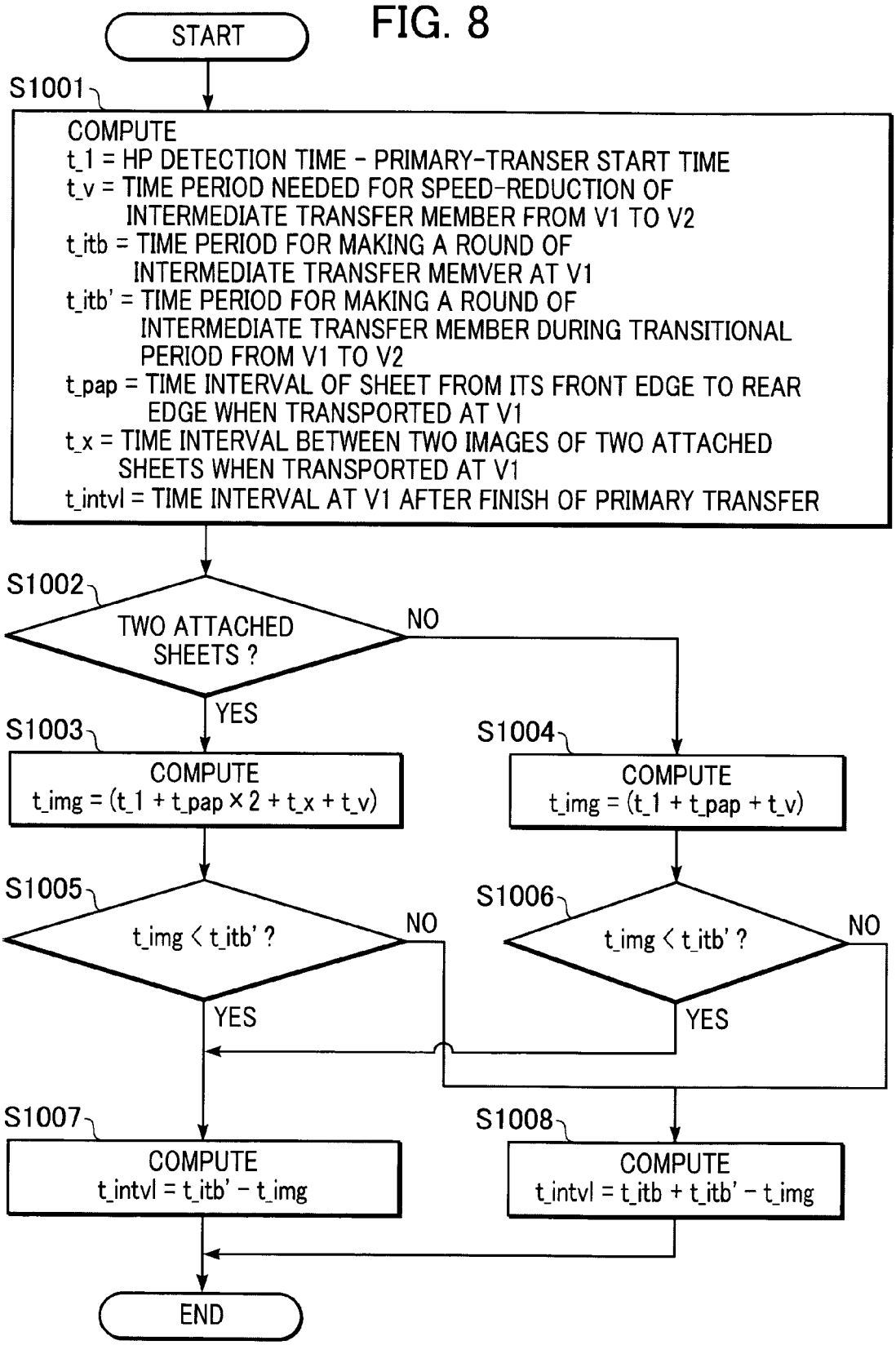
FIG. 8 is a flowchart for computing a time interval t_intvl from finish of a primary transfer to start of reduction of a motor speed toward a speed of V2.

FIG. 8 is a flowchart for computing the time interval t_intvl from completion of primary transfer to start of speed reduction of the motor to V2. The time interval t_intvl based on this flowchart is computed at any point in time before the primary transfer, such as when an image formation mode is selected (e.g., sheet type and number of images).

First, in Step S1001, the following time periods are computed or previously stored: a time period t_l (period from detection of an HP signal of the intermediate transfer member 205 to start of primary transfer), a time period t_v (period needed for the speed reduction of the intermediate transfer member 205 from V1 to V2), a time period t_itb (period needed for the intermediate transfer member 205 to make a round at the speed of V1), a time period t_itb' (period needed for the intermediate transfer member 205 to make a round at V1 and during its transitional period from the speed of V1 to the speed of V2), a time interval t_pap of a sheet from its front edge to rear edge when the sheet is being transported at the speed of V1, and a time interval t_x between two sub-images in the double image mode.

The time period t_itb' is slightly longer than the time period t_itb since the former includes the transitional period for reducing speed from the speed of V1 to the speed of V2.

Next, the number of images to be formed on the entire loop of the intermediate transfer member 205 is determined in Step S1002. When the number indicates double image mode, the process moves to Step S1003. Otherwise (i.e., the number indicates a single image mode), the process moves to Step S1004.

In other words, the CPU 301 controls the timing of start of speed reduction of the motor to V2 after completion of the primary transfer in accordance with the number of toner images to be formed on the entire loop of the intermediate transfer member 205. That is, the CPU 301 determines the number of rotations of the intermediate transfer member 205 up to the secondary transfer in accordance with the number of toner images to be formed on the entire loop of the intermediate transfer member 205. The CPU 301 controls the timing of the reducing speed of the intermediate transfer member 205 in accordance with the determination of the number of rotation of the intermediate transfer member 205 up to the secondary transfer. Particularly, the CPU 301 determines, based on the number of images to be formed on the entire loop of the intermediate transfer member 205, whether speed reduction can occur during the same rotation in which primary transfer is completed or during a following rotation.

In Step S1003, a time period t_img is computed by summing a time period (t_l+t_pap×2+t_x) from detection of an HP signal of the intermediate transfer member 205 to completion of the primary transfer of an image onto the second sheet and the time period t_v needed for reducing the speed of the motor from V1 to V2. In Step S1005, the time period t_img is compared with the time period t_itb' needed for the intermediate transfer member 205 to make a round during its transitional period from the speed of V1 to the speed of V2.

When t_img is shorter than t_itb', the process moves to Step S1007, and when t_img is not shorter than t_itb', the process moves to Step S1008.

Figure 9:
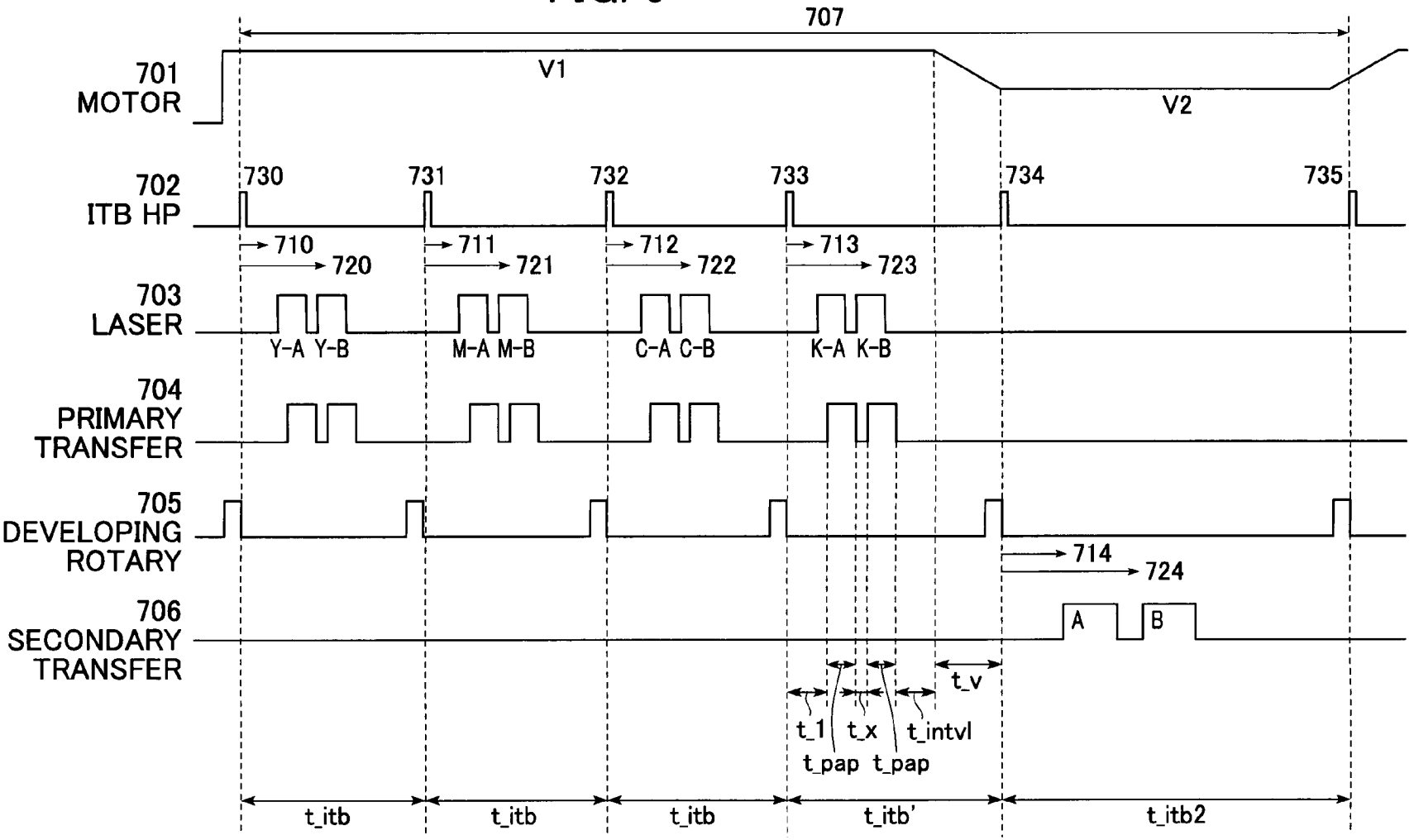
FIG. 9 is a timing chart for forming an image in the double image mode for thick paper.
Figure 10:
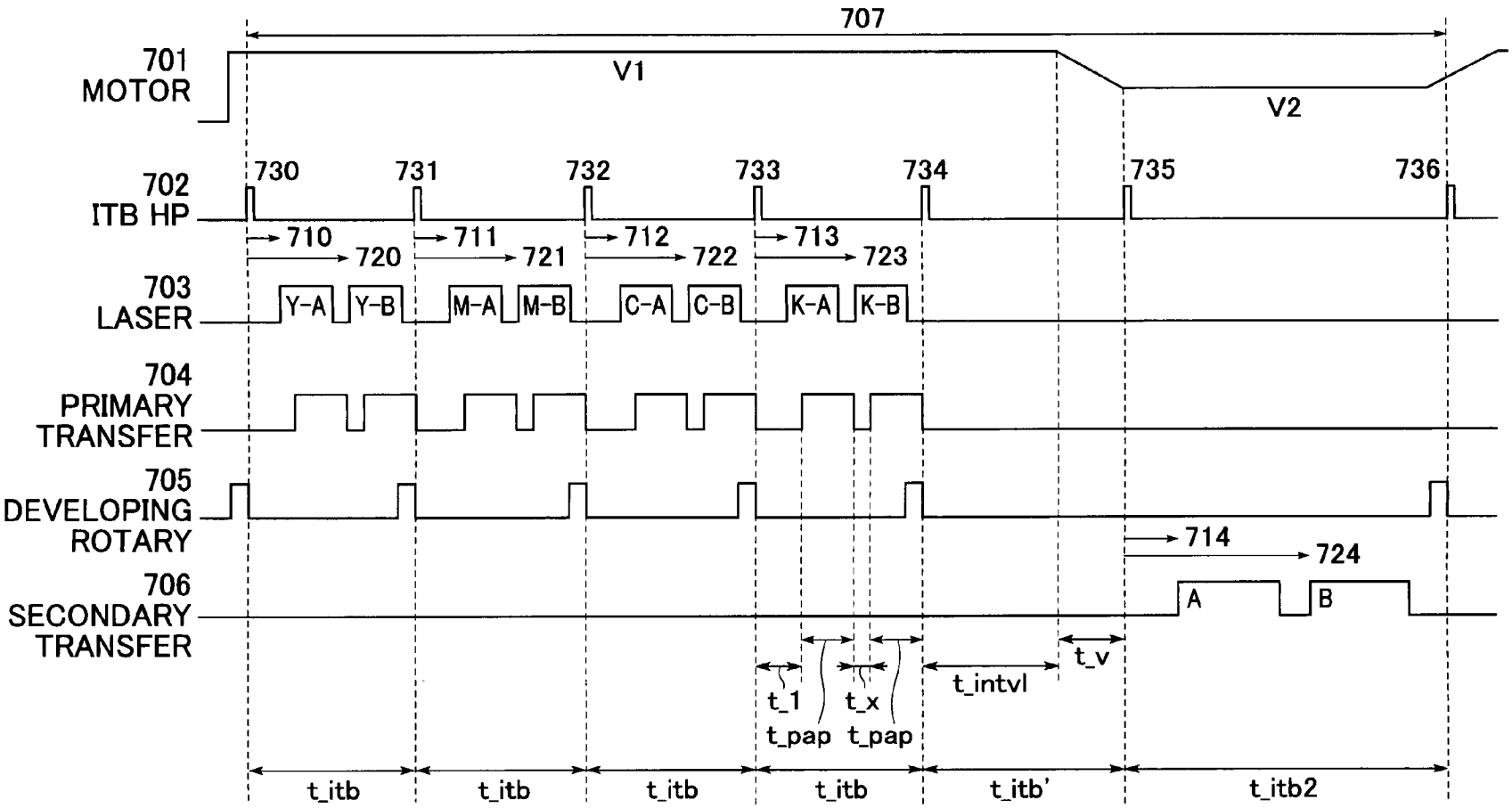
FIG. 10 is a timing chart for forming an image in the double image mode for thick paper.

FIGS. 9 and 10 are timing charts for forming an image in the double image mode for thick paper under the conditions of t_img<t_itb' and t_img≧t_itb', respectively.

In Step S1007, since a time flow of the image-forming operation of the image forming apparatus catches up with detection timing of the HP signal 734 if the speed of the motor is reduced to V2 immediately after finish of the primary transfer, as shown in FIG. 9, the HP signal 734 is used as a reference signal for start of the secondary transfer.

In Step S1007, the time interval t_intvl (t_itb'−t_img) is computed, taking into consideration the sheet size and the number of images on the entire loop of the intermediate transfer member 205. The intermediate transfer member 205 remains rotating at the speed of V1 until lapse of the time interval t_intvl. The speed of the intermediate transfer member 205 is reduced to V2 after the lapse of the time interval t_intvl. That is, the CPU 301 determines that both primary transfer for the last color (black) and speed reduction of the intermediate transfer member 205 can be performed within one rotation of the intermediate transfer member 205. The CPU 301 controls the timing of the reducing speed of the intermediate transfer member 205 in accordance with the determination so that the secondary transfer is performed immediately after the reducing speed. Thereby, the speed reduction of the intermediate transfer member 205 to V2 is finished before detection of the HP signal 734. That is, the CPU 301 controls the speed reduction so as to be performed after finish of the primary transfer and immediately before start of the secondary transfer. When the CPU 301 starts the pair of registration rollers 269 to be driven upon detection of the HP signal 734, a recording sheet is fed into the nip between the secondary transfer roller 206 and the intermediate transfer member 205. Then, the CPU 301 controls the bias voltage of the secondary transfer roller 206 so as to start the secondary transfer when the front edge of an image on the intermediate transfer member 205 passes through its secondary transfer position. With this arrangement, the HP signal 734 can be detected more quickly, leading to reduction in the period 707 and improvement in productivity.

In Step S1008, since the time flow of the image-forming operation of the image forming apparatus does not catch up to detection timing of the HP signal 734 even when the speed of the motor is reduced to V2 immediately after finish of the primary transfer, as shown in FIG. 10, the HP signal 735 is used as a reference signal for start of the secondary transfer. In this case, although the front edge of an image on the intermediate transfer member 205 passes through the secondary transfer position after finish of the primary transfer and before detection of the HP signal 735, the CPU 301 controls the bias voltage of the secondary transfer roller 206 so as to inhibit start of the secondary transfer in the above time period.

In Step S1008, the time interval t_intvl (t_itb+t_itb'−t_img) is computed, taking into consideration the sheet size and the number of images to be formed on the entire loop of the intermediate transfer member 205. The intermediate transfer member 205 remains rotating at the speed V1 until lapse of the time interval t_intvl after finish of the primary transfer. The speed thereof is reduced to V2 after the lapse of the time interval t_intvl. That is, the CPU 301 determines that the primary transfer for the last color (black) and the speed reduction of the intermediate transfer member 205 are performed within two rotations of the intermediate transfer member 205. The CPU 301 controls the timing of the reducing speed of the intermediate transfer member 205 in accordance with the determination so that the secondary transfer is performed immediately after the reducing speed. Thereby, the speed reduction of the intermediate transfer member 205 to V2 is finished before detection of the HP signal 735. In other words, the CPU 301 determines that the speed reduction cannot be performed during the same rotation in which the primary transfer of the last color occurs, but must be performed during a following rotation. Further, the CPU 301 controls the timing of the speed reduction to occur after finish of the primary transfer and immediately before start of the secondary transfer. When the CPU 301 starts the pair of registration rollers 269 upon detection of the HP signal 735, a recording sheet is fed into the nip between the secondary transfer roller 206 and the intermediate transfer member 205. Then, the CPU 301 controls the bias voltage of the secondary transfer roller 206 so as to start the secondary transfer when the front edge of an image on the intermediate transfer member 205 passes through its secondary transfer position. With this arrangement, the HP signal 735 can be detected more quickly, leading to a reduction in the period 707 and an improvement in productivity.

In other words, the CPU 301 controls the image-forming operation of the image-forming apparatus such that the primary transfer is performed while the intermediate transfer member 205 is rotated at a first speed. If the distance between the front edge of an image and the secondary transfer position upon finish of the primary transfer is not smaller than a predetermined length, the speed of the intermediate transfer member 205 is reduced to a second speed with a predetermined timing so as to perform the secondary transfer. Also, if the distance is smaller than the predetermined length, the secondary transfer is not performed even when the front edge of the image reaches the second transfer position. Rather, the intermediate transfer member 205 is kept rotating at the first speed, and the speed of the intermediate transfer member 205 is then reduced to the second speed with a predetermined timing so as to perform the second transfer.

As described above, in either Step S1007 or S1008, since the CPU 301 determines a timing for the speed reduction on the basis of the size of a sheet stored in the memory 302 and controls the motor so as to rotate the intermediate transfer member 205 at the speed V1 during the time interval t_intvl after finish of the primary transfer, when compared to the conventional case where the speed is reduced to V2 immediately after finish of the primary transfer, the HP signal 735 can be detected more quickly, leading to a reduction in the period 707 and an improvement in productivity.

Figure 11:
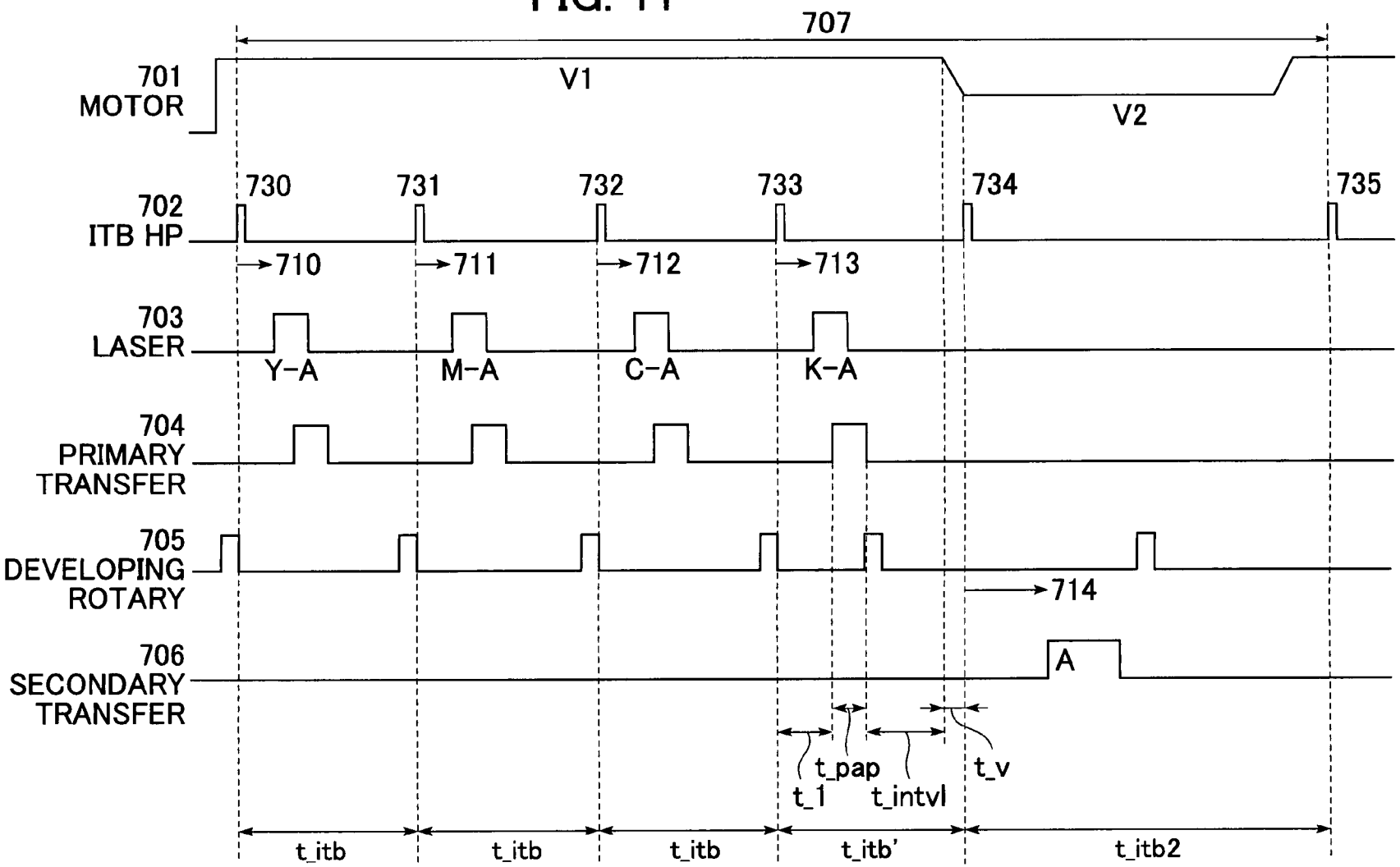
FIG. 11 is a timing chart for forming an image in the single image mode for thick paper.
Figure 12:
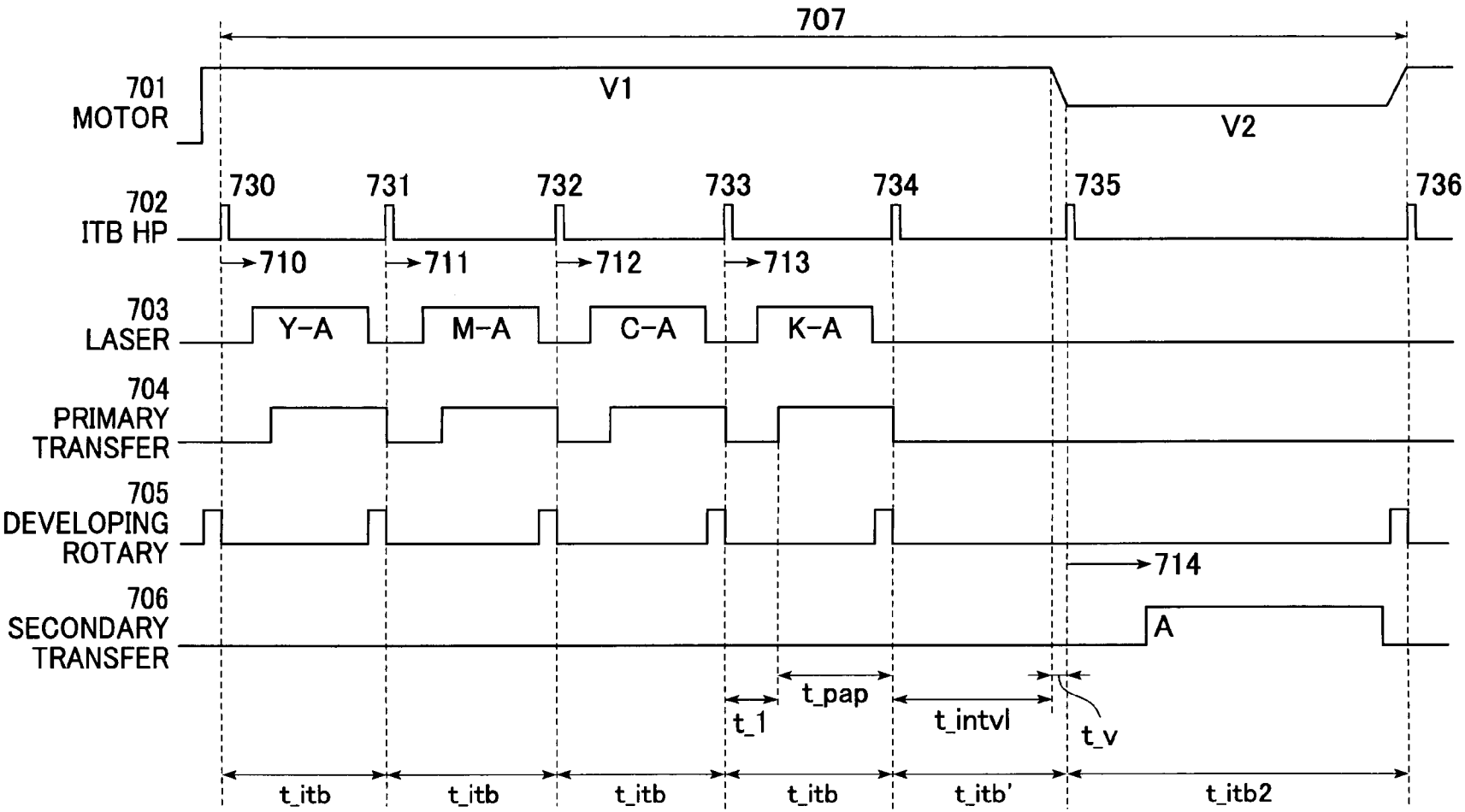
FIG. 12 is a timing chart for forming an image in the single image mode for thick paper.

Referring now to FIGS. 11 and 12, example timing charts for forming an image in the single image mode will be described.

FIGS. 11 and 12 are timing charts for forming an image in the single image mode of thick paper under the conditions of t_img<t_itb and t_img≧t_itb, respectively.

In FIGS. 11 and 12, t_itb and t_v are set differently from those in FIGS. 6, 7, and so forth.

When the number indicating a single image mode in Step S1002 shown in FIG. 8 has been determined, in Step S1004, the time period t_img (t_+t_pap+t_v) is computed by summing the time period t_l after detection of an HP signal of the intermediate transfer member 205 to start of the primary transfer in the single image mode, the time interval t_pap from start to finish of the primary transfer, and the time period t_v needed for the speed reduction of the intermediate transfer member 205 from V1 to V2.

Then, in Step S1006, the time period t_img is compared with the time period t_itb' needed for the intermediate transfer member 205 to make a round at the speed of V1 and during its transitional period from the speed of V1 to the speed of V2.

If t_img<t_itb', that is, the time period t_img is shorter than the time period t_itb', the process proceeds to STEP S1007. If t_img≧t_itb', that is, the time period t_img is not shorter than the time period t_itb', the process proceeds to Step S1008.

In Step S1007, since the time flow of the image-forming operation of the image forming apparatus catches up with detection timing of the HP signal 734 if the speed of the motor is reduced to V2 immediately after finish of the primary transfer, as shown in FIG. 11, the HP signal 734 is used as a reference signal to start secondary transfer.

In Step S1007, the time interval t_intvl (t_itb'−t_img) is computed. The intermediate transfer member 205 is rotated at the speed of V1 during the time interval t_intvl after finish of the primary transfer, taking into consideration the size of the sheet, and after the lapse of the above-mentioned time interval, the speed thereof is reduced to V2. That is, the CPU 301 controls the speed reduction to occur after finish of the primary transfer and immediately before start of the secondary transfer. When the CPU 301 starts the pair of registration rollers 269 upon detection of the HP signal 734, a recording sheet is fed into the nip between the secondary transfer roller 206 and the intermediate transfer member 205. Then, the CPU 301 controls the bias voltage of the secondary transfer roller 206 so as to start the secondary transfer when the front edge of an image on the intermediate transfer member 205 passes through its secondary transfer position. With this arrangement, the HP signal 734 can be detected more quickly, leading to a reduction in the period 707 and an improvement in productivity.

In Step S1008, since the time flow of the image-forming operation of the image forming apparatus does not catch up with detection timing of the HP signal 734 even when the speed of the motor is reduced to V2 immediately after finish of the primary transfer, as shown in FIG. 12, the HP signal 735 is used as a reference signal for starting secondary transfer. In this case, although the front edge of an image on the intermediate transfer member 205 passes through the secondary transfer position after finish of the primary transfer and before detection of the HP signal 735, the CPU 301 controls the bias voltage of the secondary transfer roller 206 so as to inhibit start of secondary transfer in the above time period.

In Step S1008, the time interval t_intvl (t_itb+t_itb'−t_img) is computed. The intermediate transfer member 205 is rotated at the speed V1 during the time interval t_intvl after finish of the primary transfer, taking into consideration the size of the sheet, and after the lapse of the above-mentioned time interval, the speed thereof is reduced to V2. That is, the CPU 301 controls the speed reduction to occur after finish of the primary transfer and immediately before start of the secondary transfer. When the CPU 301 starts the pair of registration rollers 269 upon detection of the HP signal 735, a recording sheet is fed into the nip between the secondary transfer roller 206 and the intermediate transfer member 205. Then, the CPU 301 controls the bias voltage of the secondary transfer roller 206 so as to start the secondary transfer when the front edge of an image on the intermediate transfer member 205 passes through its secondary transfer position. With this arrangement, the HP signal 735 can be detected more quickly, leading to a reduction in the period 707 and an improvement in productivity.

In other words, the CPU 301 controls the image-forming operation of the image-forming apparatus such that the primary transfer is performed while the intermediate transfer member 205 is rotated at the first speed. If the distance between the front edge of an image and the secondary transfer position upon finish of the primary transfer is not shorter than a predetermined length, the speed of the intermediate transfer member 205 is reduced to the second speed with a predetermined timing so as to perform the secondary transfer. If the distance is shorter than the predetermined length, the secondary transfer is not performed even when the front edge of the image reaches the second transfer position. Rather, the intermediate transfer member 205 is kept rotating at the first speed, and the speed of the intermediate transfer member 205 is then reduced to the second speed with a predetermined timing so as to perform the second transfer.

As described above, in either Step S1007 or S1008, since the CPU 301 determines a timing for the speed reduction on the basis of the size of a sheet stored in the memory 302 and controls the motor so as to rotate the intermediate transfer member 205 at the speed V1 during the time interval t_intvl after finish of the primary transfer, when compared to the conventional case where the speed is reduced to V2 immediately after finish of the primary transfer, the HP signal 735 can be detected more quickly, leading to a reduction in the period 707 and an improvement in productivity.

As described above, in the apparatus which produces a satisfactory image by transferring a toner image onto each of a variety of sheets at an appropriate transferring speed by changing the rotating speed of the intermediate transfer member 205 during formation of the image, when the speed of the intermediate transfer member 205 is reduced to V2 in the time period after finish of the primary transfer and before the secondary transfer, a speed-reduction timing of the intermediate transfer member 205 is made as late as possible so as to shorten a time period from finish of the primary transfer to detection of an HP signal of the intermediate transfer member 205 at the speed of V2, thereby preventing a decrease in productivity.

In the case, for example, where t_v is very short and an affect of reducing the speed of the motor is negligible or where it is required to simplify the computation, t_itb' shown in FIGS. 8 to 12 may be replaced with t_itb.

In such a case, in the flowchart shown in FIG. 8, t_img and t_itb are compared to each other in Steps S1005 and S1006, t_intvl=t_itb−t_img is computed in Step S1007, and t_intvl=2×t_itb−t_img is computed in S1008.

Other Embodiments

Although the speed of the motor is reduced to V2 in the case where the type of sheet is a sheet of thick, an envelope, a postcard, an OHP sheet, a label sticker, a tabbed sheet, or a tracing paper according to the foregoing embodiment, the present invention is not limited to the above-described relationship between that type of sheet and the speed of the motor, and the apparatus may be constructed such that the speed of the motor is changed in accordance with other types of sheet.

Also, although the speed of the motor is kept rotating at V1 for a predetermined time period after finish of the primary transfer and is then reduced to V2 according to the foregoing embodiment, the speed of the motor is not limited to V1, and the apparatus may have a control system with which, by rotating the motor at a higher speed than V1 and then reducing the speed of the motor to V2, an HP signal of the intermediate transfer member 205 is detected earlier.

In such a case, the CPU 301 uses a time period t_itb" (not shown) needed for the intermediate transfer member to make a round and including transitional periods of acceleration and deceleration thereof in place of t_itb' shown in FIG. 8 in the event of determining t_intvl. Thus, the CPU 301 performs an acceleration control of the intermediate transfer member 205 during the predetermined time interval t_intvl after finish of the primary transfer and then performs a deceleration control of the same.

As described above, according to the foregoing embodiments, the time period from finish of the primary transfer to start of the secondary transfer can be shortened, thereby providing an image-forming apparatus which achieves an improvement in productivity.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus for forming a toner image on a sheet, said apparatus comprising:

a photoreceptor holding said toner image;

an intermediate transfer member rotatable at a speed;

a primary transfer device facilitating primary transfer of said toner image from said photoreceptor onto said intermediate transfer member, wherein completion of said primary transfer occurring during a primary rotation of said intermediate transfer member;

a secondary transfer device facilitating secondary transfer of said toner image from said intermediate transfer member onto said sheet;

a controller controlling said intermediate transfer member;

wherein said controller controls said intermediate transfer member to rotate at a first speed during said primary transfer;

wherein for a predetermined sheet, said controller determines, based on an image formation mode, during which rotation of said intermediate transfer member, including said primary rotation and a following rotation following said primary rotation, to change the speed of said intermediate transfer member from said first speed to a second speed, and wherein the image formation mode includes number of images on an entire loop of the intermediate transfer member.

2. The image forming apparatus of claim 1, wherein the predetermined sheet includes one of a sheet of thick paper, an envelope, a postcard, an OHP sheet, a label sticker, a tabbed sheet, and a tracing paper.

3. The image forming apparatus of claim 1, wherein the controller determines during which rotation to change the speed by determining whether a first distance between a front edge of the toner image on the intermediate transfer member and the secondary transfer device at a time of completion of the primary transfer is longer than a predetermined distance.

4. The image forming apparatus of claim 3, wherein the controller changes the speed of the intermediate transfer member from the first speed to the second speed during the primary rotation if the first distance is longer than the predetermined distance; and said controller changes the speed during the following rotation if the first distance is shorter than said predetermined distance.

5. The image forming apparatus of claim 4, wherein the controller controls the intermediate transfer member to change speed from the first speed to the second speed after the primary transfer and after a delay interval such that said intermediate transfer member rotates at said second speed during the secondary transfer.

6. The image forming apparatus of claim 1, wherein the following rotation of the intermediate transfer member is an immediately following rotation of said intermediate transfer member.

7. The image forming apparatus according to claim 1, further comprising a fixing device fixing the toner image on the sheet at a fixing speed after the secondary transfer, wherein the controller controls the speed of the intermediate transfer member substantially equal to said fixing speed.

8. The image forming apparatus according to claim 1, wherein the first speed is substantially faster than the second speed.

9. The image forming apparatus of claim 1, further comprising:

the intermediate transfer member including a marker for detecting a front edge of the toner image; and a sensor detecting the marker.

10. The image forming apparatus of claim 9, wherein, for the predetermined sheet, the controller controls the intermediate transfer member to change speed during a speed change period immediately before the sensor detects the marker.

11. A method for forming a toner image on a predetermined sheet in an image forming apparatus including a photoreceptor, a rotatable intermediate transfer member, a primary transfer device, and a secondary transfer device, the method comprising the following steps:

determining an image formation mode;

generating a toner image on the photoreceptor;

rotating the intermediate transfer member at a first speed and performing primary transfer of the toner image from the photoreceptor onto the intermediate transfer member, wherein completion the primary transfer occurring during a primary rotation of the intermediate transfer member;

responsive to determining the image formation mode, determining whether to change rotation speed of the intermediate transfer member from the first speed to a second speed during the primary rotation or a following rotation of the intermediate transfer member;

responsive to determining whether to change rotation speed, delaying for a delay period, changing rotation speed of the intermediate transfer member from the first speed to the second speed during the primary rotation or the following rotation, and then transferring the toner image from the intermediate transfer member onto the predetermined sheet, and wherein the step of determining the image formation mode includes determining number of images formed on the imtermediate transfer member and size of the toner image.

12. The method of claim 11, wherein the predetermined sheet includes one of a sheet of thick paper, an envelope, a postcard, an OHP sheet, a label sticker, a tabbed sheet, and a tracing paper.

13. The method of claim 11, wherein the step of determining whether to change rotation speed includes:

determining a first distance between a front edge of the toner image and the secondary transfer device at a time of completion of the primary transfer; and determining whether the first distance is longer or shorter than a predetermined distance.

14. The method of claim 13, wherein responsive to determining the first distance longer than the predetermined distance, changing the rotation speed of the intermediate transfer member from the first speed to the second speed during the primary rotation; and wherein responsive to determining the first distance shorter than the predetermined distance, changing said rotation speed of said intermediate transfer member from said first speed to said second speed during the following rotation.

15. The method of claim 14, further including the following steps:

fixing the toner image onto the sheet at a fixing speed; and maintaining the rotation speed of the intermediate transfer member and the fixing speed substantially the same during the fixing step.

16. The method of claim 11, wherein the first speed is faster than the second speed.

17. The method of claim 11, further comprising:

providing the intermediate transfer member with a marker for detecting a front edge of the toner image;

detecting the marker; and changing the rotation speed during a speed change period immediately before detecting the marker.

18. An image forming apparatus for forming a toner image on a sheet, said apparatus comprising:

a photoreceptor holding said toner image;

an intermediate transfer member rotatable at a speed;

a primary transfer device facilitating primary transfer of said toner image from said photoreceptor onto said intermediate transfer member, wherein completion of said primary transfer occurs during a primary rotation of said intermediate transfer member;

a secondary transfer device facilitating secondary transfer of said toner image from said intermediate transfer member onto said sheet;

a controller controlling said intermediate transfer member;

wherein said controller controls said intermediate transfer member to rotate at a first speed during said primary transfer, wherein for a predetermined sheet, said controller determines, based on an image formation mode, during which rotation of said intermediate transfer member, including said primary rotation and a following rotation following said primary rotation, to change the speed of said intermediate transfer member from said first speed to a second speed, and wherein the image formation mode includes size of the sheet.

* * * * *